US008065829B2

(12) United States Patent
Hill

(10) Patent No.: US 8,065,829 B2
(45) Date of Patent: Nov. 29, 2011

(54) SIGN ASSEMBLY

(75) Inventor: G. Roland Hill, Stockport (GB)

(73) Assignee: Contra Vision Limited, Stockport (GB)

( * ) Notice: Subject to any disclaimer, the term of this patent is extended or adjusted under 35 U.S.C. 154(b) by 73 days.

(21) Appl. No.: 12/122,007

(22) Filed: May 16, 2008

(65) Prior Publication Data

US 2008/0282591 A1 Nov. 20, 2008

Related U.S. Application Data

(60) Provisional application No. 60/938,576, filed on May 17, 2007.

(51) Int. Cl.
*A47G 1/06* (2006.01)

(52) U.S. Cl. ..... 40/706; 40/703; 40/768

(58) Field of Classification Search ..... 40/723, 40/773, 701, 709; 206/456, 449, 39, 232
See application file for complete search history.

(56) References Cited

U.S. PATENT DOCUMENTS

| | | | | | |
|---|---|---|---|---|---|
| 3,069,795 | A * | 12/1962 | Lieberman | 40/701 |
| 3,736,684 | A * | 6/1973 | Grad | 40/782 |
| 4,146,985 | A * | 4/1979 | Margulies | 40/710 |
| 5,405,146 | A * | 4/1995 | Washington | 273/157 R |
| 5,533,288 | A * | 7/1996 | Lambert | 40/754 |
| 5,635,265 | A * | 6/1997 | Potokar | 428/43 |
| 5,950,342 | A * | 9/1999 | Suesholtz | 40/768 |
| 6,092,320 | A * | 7/2000 | Bringuet | 40/618 |
| 6,212,805 | B1 | 4/2001 | Hill | |
| RE37,186 | E | 5/2001 | Hill | |
| 6,389,724 | B1 * | 5/2002 | Cumberland | 40/778 |
| 6,643,965 | B2 * | 11/2003 | Toraby-Payhan | 40/600 |

FOREIGN PATENT DOCUMENTS

| | | |
|---|---|---|
| EP | 0511123 A1 | 10/1992 |
| GB | 2300351 A | 11/1996 |

OTHER PUBLICATIONS

Search Report from British Patent Application No. GB0809064.9, dated Aug. 27, 2008.

* cited by examiner

*Primary Examiner* — Joanne Silbermann
*Assistant Examiner* — Shin Kim
(74) *Attorney, Agent, or Firm* — Pillsbury Winthrop Shaw Pittman LLP

(57) ABSTRACT

A sign assembly includes a base material, a filmic substrate imaged with a design, and a sign assembly frame that includes a sign framing member of fixed position in relation to the base material. The sign framing member includes a projecting portion terminating at an inside edge of the sign framing member. The display sign is adhered to the base material. The inside edge of the sign framing member is located within the projected area of the display sign and is spaced from the base material and the filmic substrate. The display sign is capable of being applied through an opening defined by the inside edge of the sign framing member. The space between the inside edge of the projecting portion and the display sign includes a void.

34 Claims, 8 Drawing Sheets

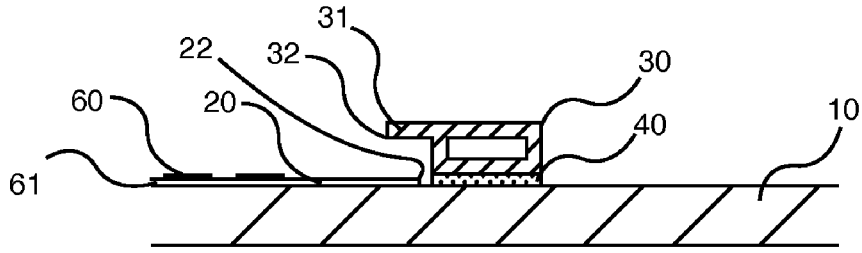
Fig.2 X-X
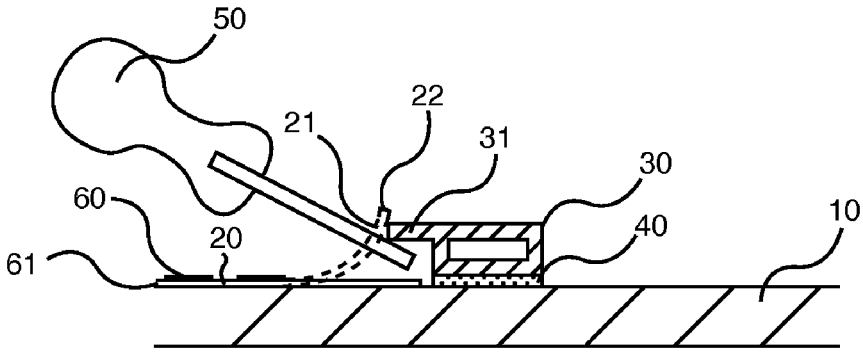
Fig.3 X-X
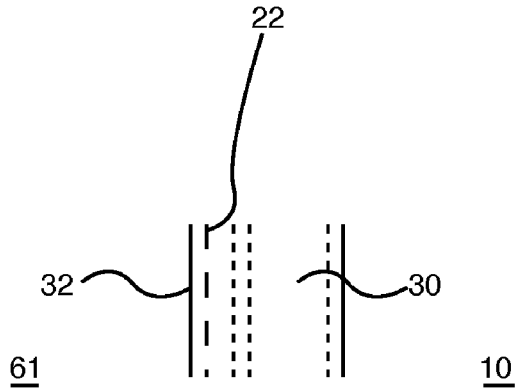
Fig.4

SIGN ASSEMBLY

CROSS-REFERENCE

This application claims the benefit of priority to U.S. Provisional Patent Application No. 60/938,576, titled "SIGN ASSEMBLY," filed on May 17, 2007, which is incorporated herein by reference.

BACKGROUND OF THE INVENTION

1. Field of the Invention

The present invention relates generally to a sign assembly comprising a base material, for example window glass, a sign framing member, and a sign display which is removable and replaceable.

2. Description of Related Art

Filmic display signs are well known. Self-adhesive film and static cling film window graphics are also known, in which a substrate material, for example a self-adhesive pvc or polyester film, is imaged with a design, such as an information sign or advertisement, and adhered to the surface of a window. Also known are see-through window graphics, for example, according to US RE37,186 and U.S. Pat. No. 6,212,805 comprising a partially imaged transparent panel allowing through-vision in one or both directions.

A major problem with such self-adhesive signs is that the stronger the adhesive, in terms of initial "tack", the more difficult it is to reposition a sign if it is initially applied in an incorrect position or alignment, for example at a slope to the vertical, or with creases. High long term tensile, shear and peel strength also cause problems in the removal of such signs and are a significant part of the lifetime cost of so-called "space advertisements", "point-of-sale" and other advertisements or signs which are regularly changed. Another inconvenience and cost is caused by adhesive staying on the window after removal of the film, so-called "adhesive transfer." With alternatively available low tack and/or long term low adhesion pressure-sensitive adhesives or static cling films, the signs are easily removable, for example by a vandal wishing to take the sign. For this reason, frames are sometimes adopted to trap the sign against the base material, such as a window, to make unwanted removal more difficult.

Framing systems include so-called sprung clip profiles or sign framing members incorporating a cam profile which reacts again a resilient base material such as a fibre board. These prior art framing systems trap the edges of the imaged substrate and the sign framing members are in direct contact with the display sign. Hinged frames for containing display signs are also known, a rectangular frame assembly being typically hinged along one side of the frame, to enabling opening and insertion of a display sign.

In order to prevent the hinged, sprung or cam profiles being opened by a member of the public, one or more locking devices are typically incorporated. This unlocking, opening, closing and relocking adds to the time and cost of changing a display sign. Also, such mechanical hinged, spring clip or cam framing systems are typically of light construction and easily subject to vandalism, for example forced opening.

SUMMARY OF EMBODIMENTS OF THE INVENTION

According to one embodiment of the present invention, a sign assembly comprises base material, a filmic substrate imaged with a design, and a sign assembly frame comprising a sign framing member of fixed position in relation to the base material, said sign framing member comprising a projecting portion terminating at an inside edge of said sign framing member, wherein said display sign is adhered to said base material, wherein said inside edge of said sign framing member is located within the projected area of said display sign and is spaced from said base material and said filmic substrate, wherein the display sign is capable of being applied through an opening defined by the inside edge of said sign framing member, and wherein the space between said inside edge of said projecting portion and said display sign comprises a void.

According to a second embodiment of the invention, there is a method of applying a display sign to a base material through a sign assembly frame, the sign assembly frame comprising a sign framing member, the method comprising: inserting the display sign through an opening of a sign assembly frame that is in a fixed position in relation to the base material such that an inside edge of an inwardly projecting portion of said sign framing member is located within a projected area of said display sign; and adhering the display sign to the base material.

There is also a method of removing a sign display from a sign assembly, the method comprising: applying a suction device to the exposed surface of said sign display, said exposed surface being remote from said base material, activating said suction device and pulling said suction device to remove said sign display with said suction device.

The projected area of the display sign is a prismic space, the perimeter of which is coincident with the perimeter of the display sign.

Example base materials include glass, plastic sheet materials, for example of acrylic, polycarbonate, pvc and petg, or other typically smooth-surfaced materials, such as stove-enameled metals. However, it is to be understood that the base material can be any sheet material.

The sign framing member is in a fixed position in relation to the base material, not being capable of hinging, rotating, sliding or otherwise being moved in relation to the base material. Optionally, the sign framing member is immovably attached to the base material (immovable attachment still may permit some non-consequential movement between the framing member and the base material). Typically, sign framing members are located along all four sides of a sign assembly, optionally with mitered joints at their intersection. Optionally, one or more sides of the sign assembly comprises a mechanical framing member, for example a sprung clip framing member. For example, another embodiment comprises a rectangular sign assembly frame comprising three sign framing members of fixed position in relation to the base material and one mechanical framing member which is openable, for example to allow a display sign edge to be exposed to assist removal and replacement. Sign framing members are typically independent profiles, for example of aluminum or plastic, or are an integral part of a main framing member, for example the main framing member of a glazed door or window. For example, an otherwise conventional door or window frame incorporates a section which projects over and is spaced from and in a fixed position in relation to the base material.

Typically, there are holes in at least a lower framing member, to allow drainage of any fluid such as application fluid, cleaning fluid or rain. Such holes or holes optionally introduced into other sign framing members optionally allow access for a probe tool to lift the edge of the filmic substrate by a suitably equipped and skilled person when changing the display sign.

Optionally, the sign assembly frame and base material are integrally formed with each other.

Filmic substrates include plastic films, for example polyester, pvc (including highly plasticized, so-called static cling, pvc), acrylic or polycarbonate films and paper. The filmic substrates typically have a relatively low tack and long term low adhesion to the base material, preferably over all the surface area of the filmic substrate, either by virtue of the filmic substrate properties, for example static cling pvc, or by virtue of a low-tack, low-strength pressure-sensitive adhesive, for example an acrylic- or urethane-based pressure-sensitive adhesive layer, or a surface which naturally adheres to the base material surface when they are in intimate contact.

A particularly economic embodiment of the invention is one in which the filmic substrate has no adhesive material coating and preferably has no need for a protective liner. In some such embodiments, for example using polyester film, intimate contact between the film and a suitably smooth base material, for example glass, can be achieved merely by squeegeeing the film against the base material to exclude any significant air bubbles, with or without the use of water or other application fluid. In other such embodiments, wedges or spacers, optionally comprising compressible material such as plastic foam, can be used to hold the filmic substrate against the base material at discrete positions, for example at the four corners of a rectangular assembly and optionally at other points along the length of the sign framing member.

The filmic substrate is imaged with the design, for example by any printing method, and is optionally overlaminated with a protective film or coating, to form the sign display. The display signs optionally comprise opaque, translucent or transparent film substrates, including see-through graphic panels according to US RE37,186 or U.S. Pat. No. 6,212,805.

Application of the sign display to the base material is optionally with or without the use of an application fluid, for example a dispersion of soap in water or a proprietary fluid such as Madico Z. To enable the display sign to be quickly applied, be repositionable and easily removable, the adhesion of the filmic substrate to the base material is relatively low. The adhesive properties of filmic materials are typically categorized as:

(i) "tack", the initial "stickiness" upon application to a base material with no laminating pressure, (ii) "shear strength", a measure of the "in plane" strength, and (iii) "peel strength", most relevant to one or more embodiments of the present invention, being the force to remove a film by peeling after a particular dwell time in a standard test procedure.

In a standard AFERA test procedure, at 23° C., at an angle of 90° to the base material, at a peeling speed of 300 mm/minute, the average peeling force is preferably less than 400 gm, more preferably less than 200 gm, and even more preferably less than 100 gm.

The filmic substrate is typically sufficiently flexible for an edge to be maneuvered from a position in front of or above the sign framing member to a position in intimate contact with the base material and extending under the inside edge of the sign framing member, typically by means of a squeegee. Suitable filmic substrates include, among others, polyester, pvc, acrylic or polycarbonate film, typically of less than 1 mm thickness, preferably less than 0.5 mm thickness and, more preferably, in the range of 10-100μ thickness. One suitable proprietary product is a self-adhesive polyester film, Raycling™, manufactured by Rayven, Inc., US.

The corners of the filmic substrate are optionally chamfered, curved or notched, typically a square notch, preferably with an internal radius, to facilitate the squeegeeing of the edges of the film underneath the internal edges of the sign framing members. Each edge of the filmic substrate is typically located to be spaced within the width of a sign framing member such that removal of the film by lifting the edge of the film by a fingernail is effectively prevented.

After application to the base material, the entire perimeter of the display sign is typically disposed between the sign assembly frame and the base material.

Optionally, an existing display sign in such a sign assembly is removed by the application of a surface pulling force, typically towards an edge and preferably near the corner of the filmic substrate, for example by means of a suction device, for example as typically used in the handling of glass, or the application and pulling of self-adhesive tape or other self-adhesive surface. The release of one corner enables the remainder of the display sign to be easily pulled away from the base material. Alternatively, the initial raising of an edge of the display sign can be achieved by means of a probe tool inserted through an aperture through or under a sign framing member.

One or more embodiments of the invention thus provide good security against undesired removal of the display sign but quick and efficient removal when so desired by an authorized person changing the display sign.

Additional and/or alternative objects, features, aspects, and advantages of one or more embodiments of the present invention will become apparent from the following description, the accompanying drawings, and the appended claims.

BRIEF DESCRIPTION OF THE DRAWINGS

For a better understanding of embodiments of the present invention as well as other objects and further features thereof, reference is made to the following description which is to be used in conjunction with the accompanying drawings, where:

FIG. 2 is a cross-section through a sign framing member and a display sign affixed to a base material.

FIG. 3 is a cross-section through a sign framing member and a base material showing the application of a display sign.

FIG. 4 is a plan of a part of a sign framing member.

DETAILED DESCRIPTION OF EXEMPLARY EMBODIMENTS OF THE INVENTION

Figure 1:
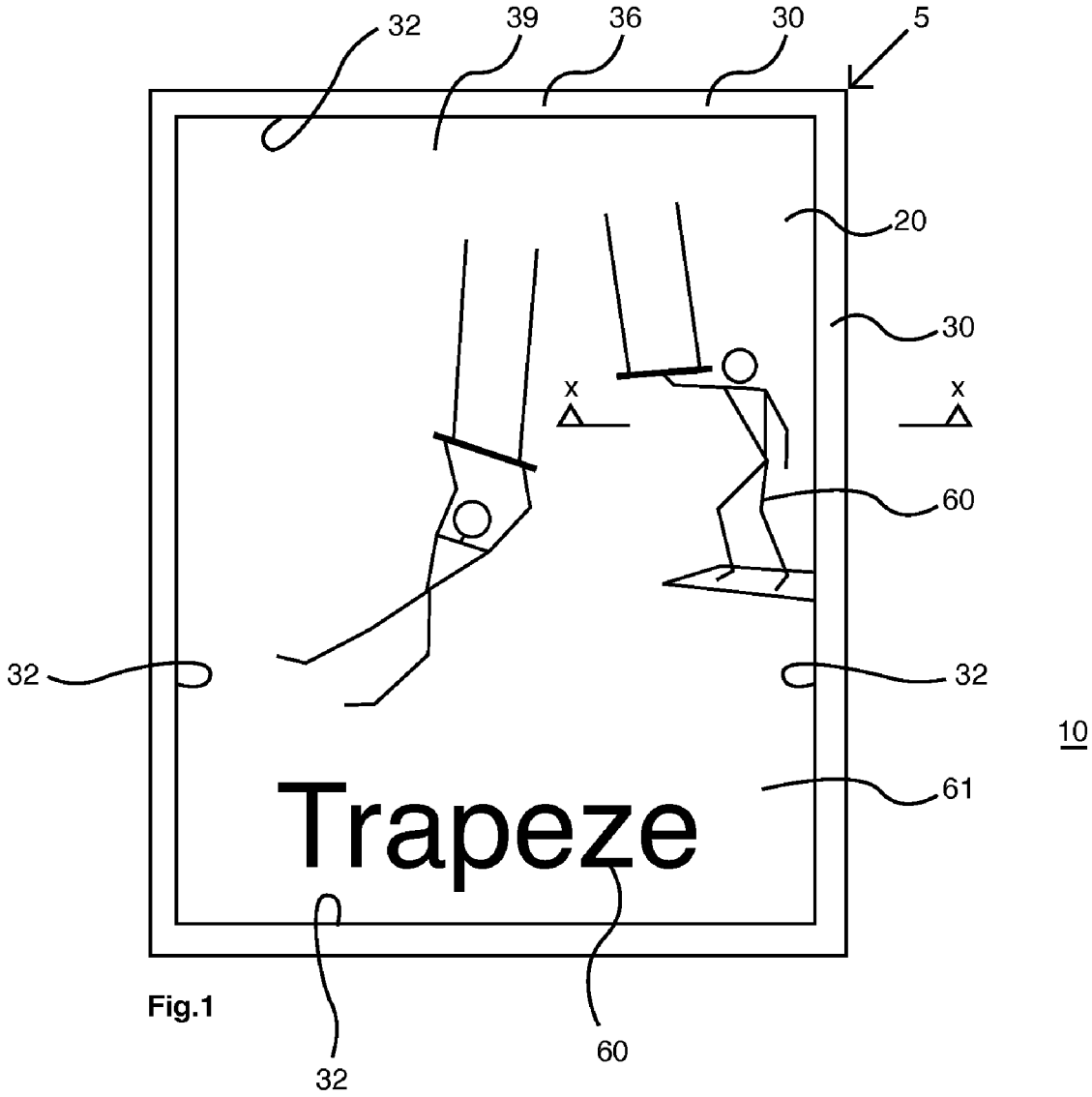
FIG. 1 is a front view of a sign assembly according to an embodiment of the present invention.

FIG. 1 illustrates a sign assembly 5 including display sign 61 comprising design 60 applied to filmic substrate 20 and a sign assembly frame 36 comprising sign framing members 30 mounted on base material 10 optionally extending beyond the sign assembly frame 36, the base material being, for example, a glass window. The inside edges 32 of sign framing members 30 define an aperture or opening within the sign assembly frame through which the display sign 61 can be inserted and adhered to the base material 10. Typically, the area of the aperture or opening within the sign assembly frame is smaller than the area of the display sign. All the sign framing members 30 of sign assembly frame 36 are in a fixed position in relation to the base material. Such fixed position or non-variable geometry of the sign framing members 30 enables them to be of robust construction, without springs, hinges or any other moving parts. The display sign is typically exposed to the atmosphere at its principal surface remote from the base material 10. There is typically a continuous perimeter gap or void between the projecting portion 31 of sign framing member 30 and the base material 10 or sign display 61 around the entire perimeter of the sign assembly frame.

In FIG. 2, sign framing member 30, for example an aluminum or plastic extruded profile, is fixed to base material 10, for example a glass window, by a fixing 40, for example of self-adhesive foamed plastic having pressure-sensitive adhesive on both a surface adhered to the base material 10 and an other surface adhered to sign framing member 30. Display sign 61 comprising design 60 on filmic substrate 20 is shown applied to base material 10. The edge 22 of filmic substrate 20 is shown to lie within the width and spaced from the inside edge 32 of projecting portion 31 of sign framing member 30, the term "inside" referring to the direction of the inside, opening or aperture of the sign assembly frame. Conversely, the inside edge 32 of sign framing member 30 is located within the projected area of the display sign, the projected area comprising an area projected perpendicularly away from the base material or projected perpendicularly to a plane defined by the opening in the sign assembly frame.

Figure 5A:
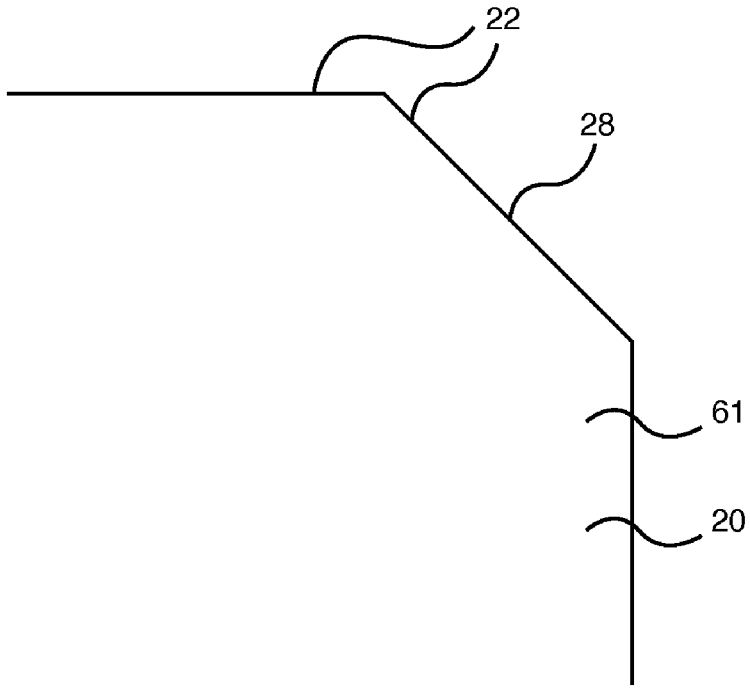
FIGS. 5A and 5B are corners of a filmic substrate.
Figure 5B:
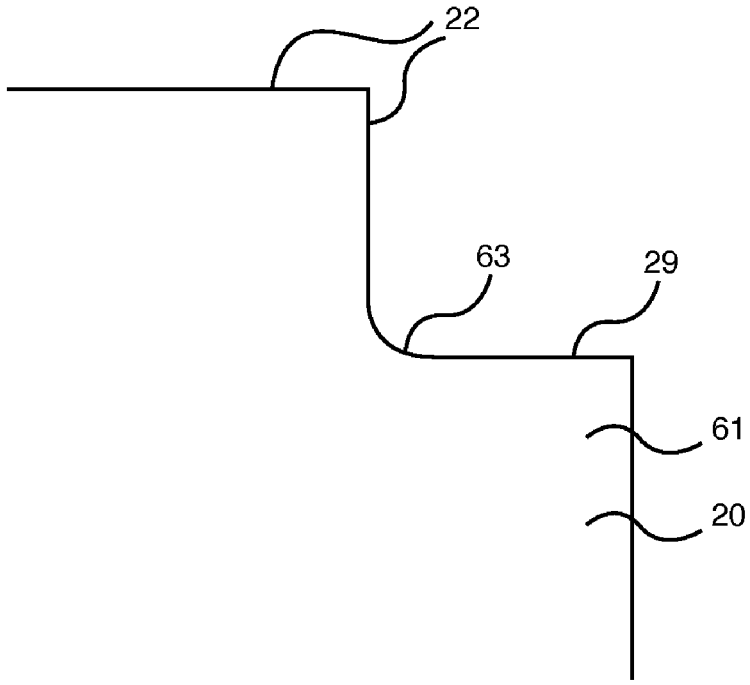

FIG. 3 illustrates the method of application of the display sign 61 comprising filmic substrate 20 to base material 10. When first applied to base material 10, the filmic substrate 20 typically has an upturned section 21 with filmic substrate edge 22, that is maneuvered under projecting portion 31, typically by means of squeegee 50, to have intimate contact with and adhered to base material 10. The filmic substrate edge 22 is then spaced inside or "trapped" within the width of sign framing member 30, as also shown on plan in FIG. 4. In order to assist this maneuvering of the edges, the corners of film substrate 20 typically have a chamfer 28 as shown in FIG. 5A or have a notch 29, optionally with internal radius 63, as illustrated in FIG. 5B. The squeegee is optionally of fixed or flexible geometry, for example of metal or neoprene, optionally with a wooden handle section or is a plastic molding, such squeegees being in common use in the art of commercial graphics and visual display.

Figure 6:
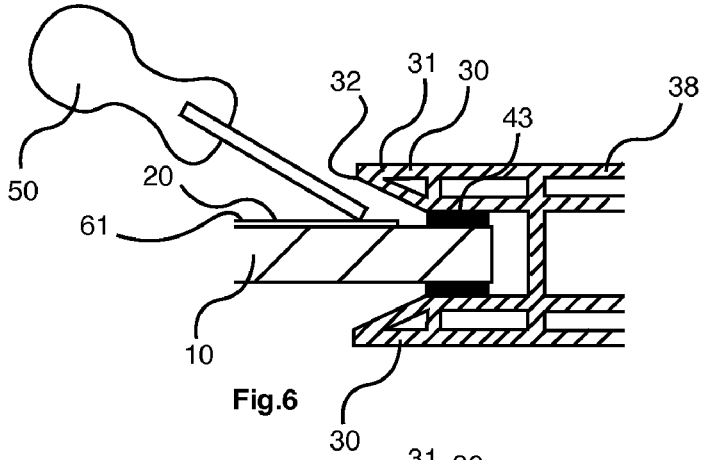
FIGS. 6 and 7 are cross-sections through a main framing member with an integral sign framing member.
Figure 7:
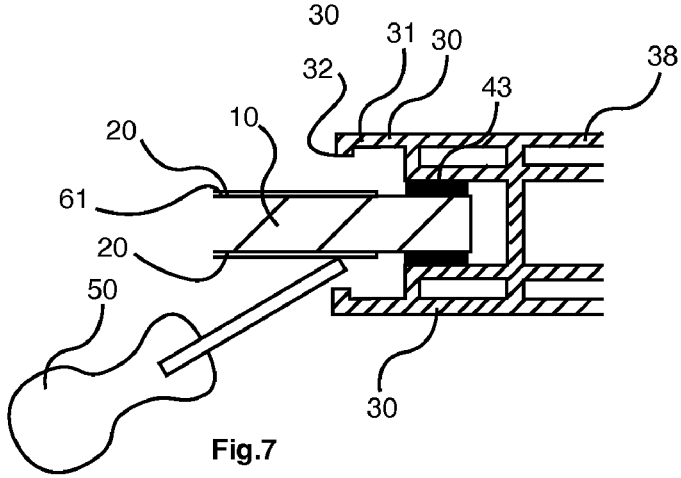

Instead of being independent, sign framing member 30 can be integral with a main framing member 38, for example of a glazed door or window, optionally with a sealant 43, for example a neoprene gasket, in between the main framing member 38 and the base material 10, for example of glass or polycarbonate sheet, as shown in FIGS. 6-9. There are many suitable profile arrangements to allow manipulation of the edge of filmic substrate 20 underneath the overhanging edge 32 of projecting portion 31 of sign framing member 30, for example as illustrated in FIG. 6 or FIG. 7, both arrangements allowing the application of a film substrate 20 on one side (as shown in FIG. 6) or both sides (as shown in FIG. 7) of the glass base material 10.

Figure 8:
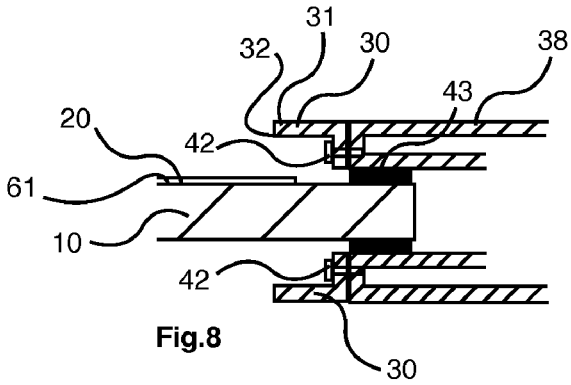
FIGS. 8 and 9 are cross-sections through a main framing member with an affixed sign framing member.
Figure 9:
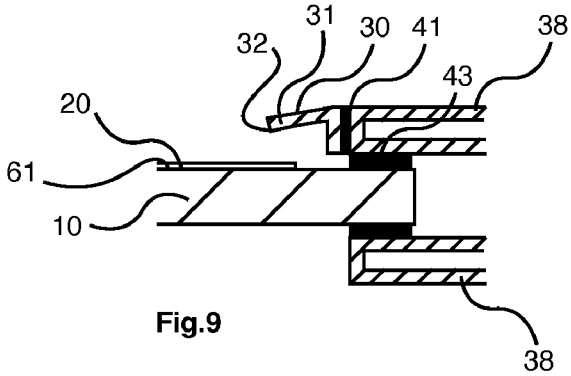

Alternatively, sign framing member 30 can be fixed to a main framing member 38, for example by self-tapping screws 42, as illustrated in FIG. 8, or by adhesive 41 as illustrated in FIG. 9.

Figure 10:
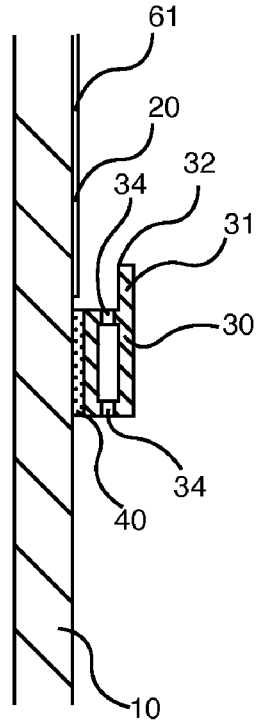
FIG. 10 is a cross-section through a bottom sign framing member.

FIG. 10 illustrates a bottom sign framing member 30 comprising drainage holes 34, to enable run-off of application fluid, cleaning fluid or rain.

Figure 11:
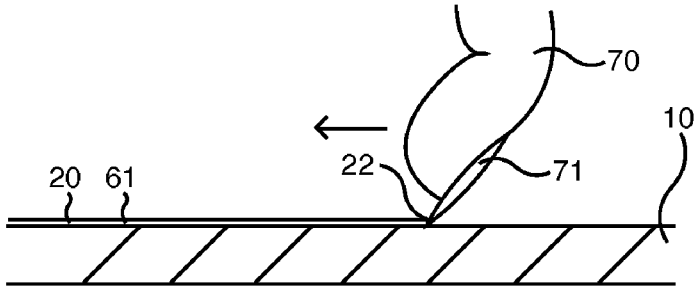
Fig.11 PRIOR ART
FIG. 11 is a PRIOR ART cross-section of a fingernail lifting a filmic substrate edge.

FIG. 11 shows that PRIOR ART lifting of a filmic substrate edge 22 by a finger 70 and fingernail 71 typically requires the fingernail 71 to be at an obtuse angle to film substrate 20 (an acute angle to the base material 10 outside the area of the filmic substrate 20).

Figure 12:
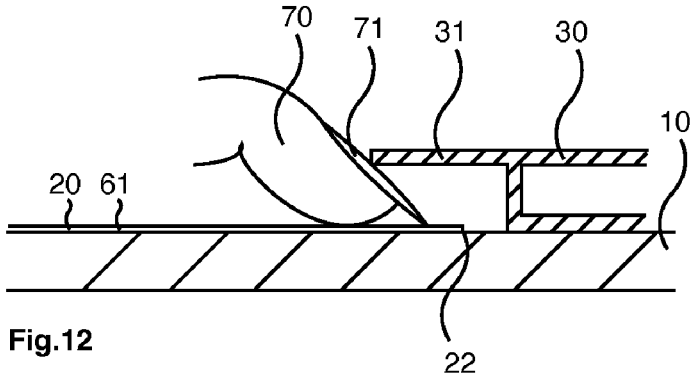
FIG. 12 is a cross-section of a fingernail prevented from lifting a trapped filmic substrate edge.

One or more embodiments of the invention allow the easy application of filmic substrate 20 to a base material 10, as well as its easy removal, but the edge "trap" provided by sign framing member 30, as illustrated in FIG. 12, effectively prevents edge lifting of the filmic substrate 20 by a fingernail 71.

Figure 13:
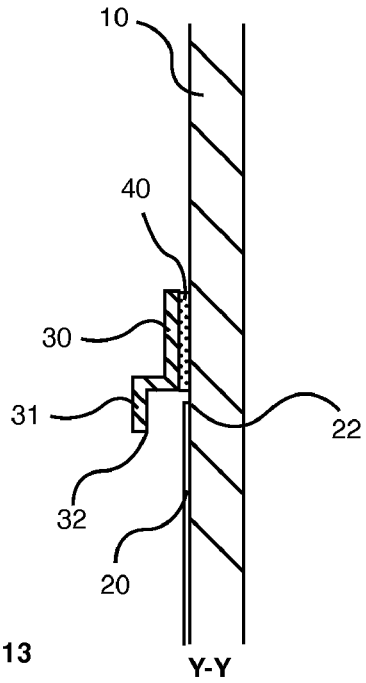
FIG. 13 is a cross-section through a sign framing member and a display sign affixed to a base material.

FIG. 13 shows an alternative sign framing member 30, for example an aluminum extruded profile fixed to base material 10, for example a glass window, by a fixing 40, for example of self-adhesive foamed plastic. The edge 22 of filmic substrate 20 is shown to lie within the width, and spaced from the inside edge 32 of projecting portion 31 of sign framing member 30.

Figure 14:
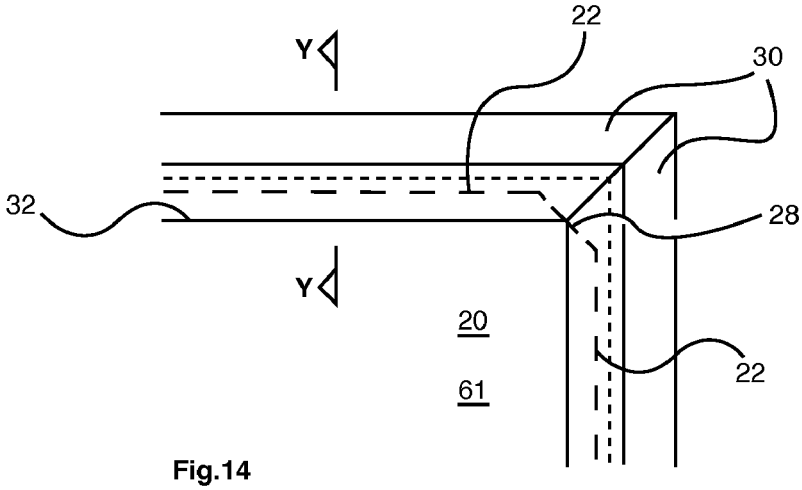
FIGS. 14, 15 and 16 are plans of corners of different sign assemblies.

FIG. 14 is a plan view of a corner of the assembly of FIG. 13, showing the obscured edge 22 of filmic substrate 20 having chamfer 28 to assist the application of sign display 61 to base material 10 by only requiring single curvature flexure of the filmic substrate 20.

Figure 15:
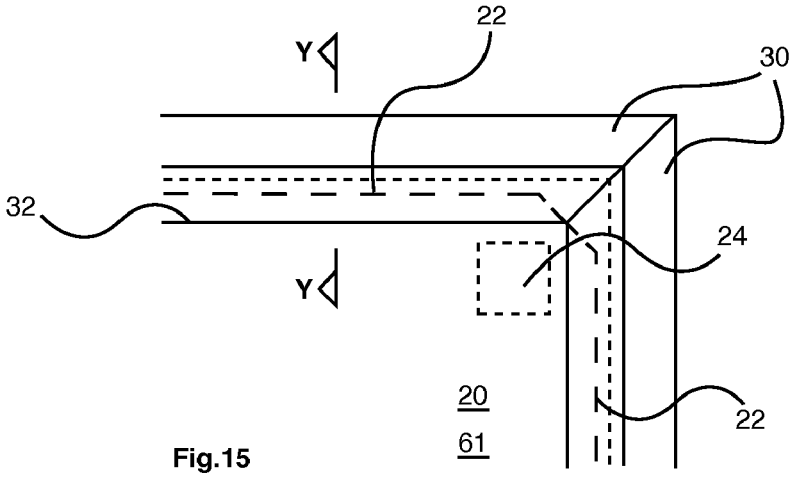

FIG. 15 is similar to FIG. 14 with the addition on optional discrete pressure-sensitive fixing 24 of the film substrate 20 to the base material 10.

Figure 16:
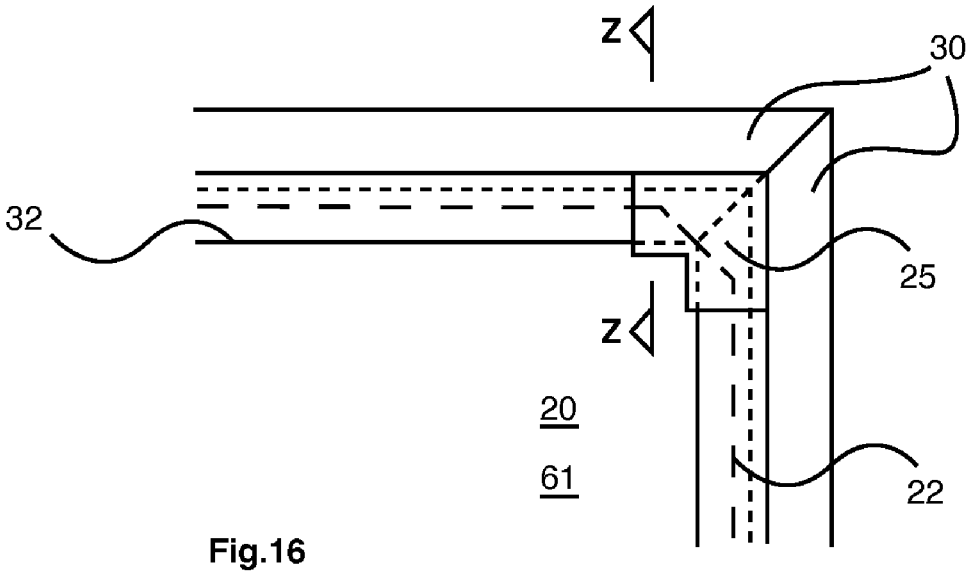
Figure 17:
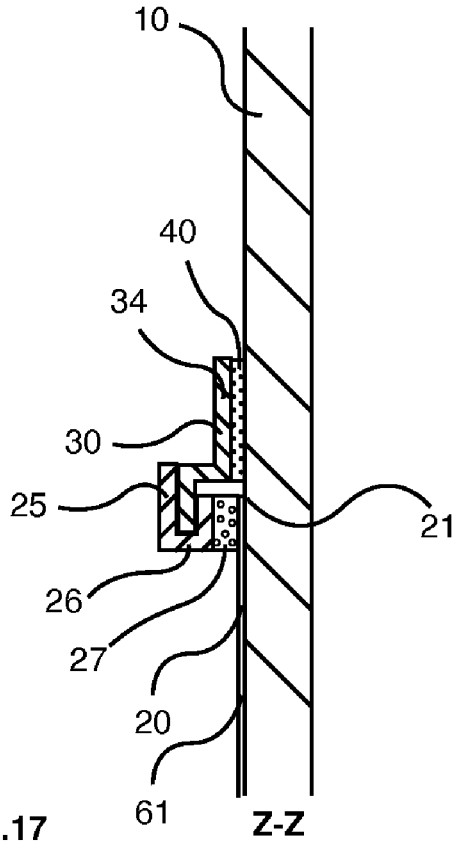
FIG. 17 is a cross-section along line Z-Z in FIG. 16.

FIG. 16 is similar to FIG. 14 with the addition of a corner wedge 25, also shown in cross-section Z-Z in FIG. 17, to provide a local means of holding down the corner of the filmic substrate 20. The corner wedge 25 optionally comprises corner wedge molding 26, for example of aluminum or plastic, and compressible plastic foam 27.

Figure 18:
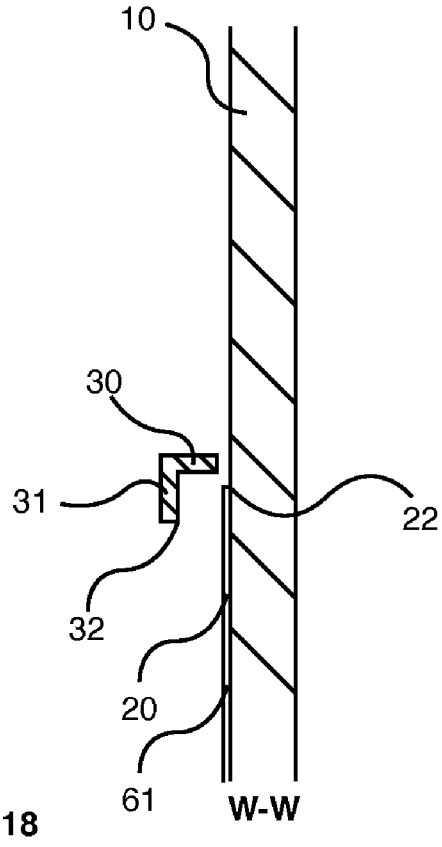
FIG. 18 is a cross-section through a sign framing member and a display sign affixed to a base material at discrete positions (not shown).

FIG. 18 illustrates yet another example of a framing member 30, for example an aluminum or plastic angle section, which is fixed to the base material 10 at discrete positions (not shown).

Figure 19:
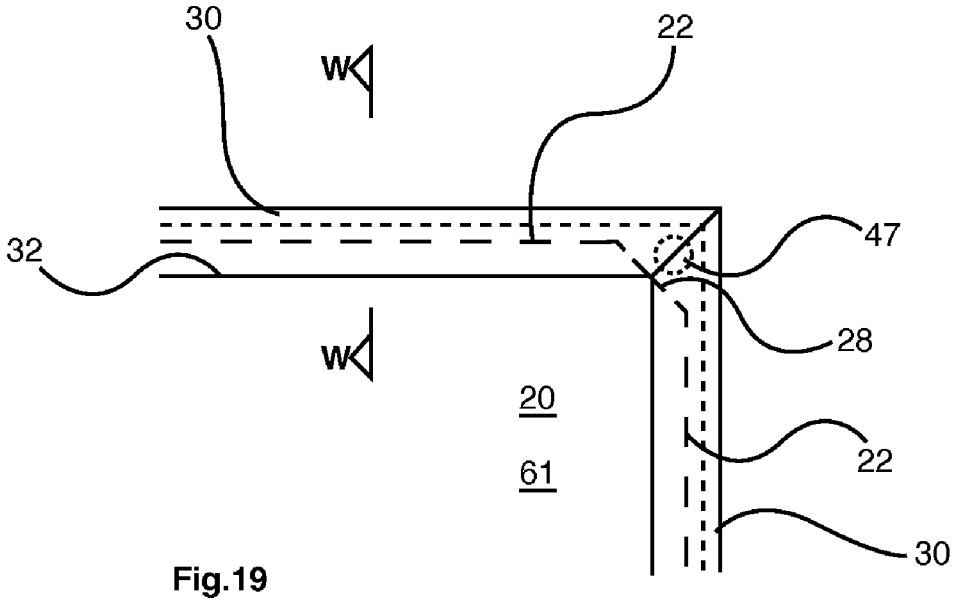
FIG. 19 is a plan of the corner of the sign assembly of FIG. 18 incorporating a discrete fixing of a sign framing member to a base material.

FIG. 19 is a corner plan of the framing member of FIG. 18 showing a discrete corner fixing 47 of the framing members 30 to the base material 10, for example a plastic foam spacer with pressure sensitive adhesive to the base material 10 and the framing members 30. It is to be understood that any discrete means of fixing the framing members 30 outside the area of filmic substrate 20 may be adopted (or omitted).

The arrangement of FIGS. 18 and 19 allows a probe tool to be inserted between a sign framing member 30 and base material 10 to initiate the removal of a display sign 61. In all embodiments, the removal of display sign 61 can be initiated by a suction tool, preferably applied to one corner of display sign 61 and pulled away from base material 10, or a hooked tool similar to a crochet hook, to be applied from inside sign assembly frame 36, hooking and pulling back an edge 22 of filmic substrate 20.

The foregoing illustrated embodiments are provided to illustrate the structural and functional principles of embodiments of the present invention and are not intended to be limiting. To the contrary, the principles of the present invention are intended to encompass any and all changes, alterations and/or substitutions within the spirit and scope of the following claims.

What is claimed is:

1. A sign assembly comprising a base material, a display sign comprising a filmic substrate imaged with a design, and a sign assembly frame comprising a sign framing member of fixed position in relation to the base material, said sign framing member comprising a top side portion, a bottom side portion, a left side portion, and a right side portion that together comprise a projecting portion terminating at an inside edge of said sign framing member, wherein said display sign is adhered to said base material, wherein at least a portion of each of said top side, bottom side, left side, and right side portions are located within the projected area of said display sign, wherein the display sign is capable of being applied to the base material through an opening defined by the inside edge of said sign framing member, wherein a continuous void exists between the projecting portion of the sign framing member and the display sign around an entire outside perimeter of the display sign.

2. A sign assembly as claimed in claim 1, wherein said base material is glass.

3. A sign assembly as claimed in claim 1, wherein said filmic substrate comprises plastic film.

4. A sign assembly as claimed in claim 1, wherein said filmic substrate comprises paper.

5. A sign assembly as claimed in claim 1, wherein said display sign comprises a corner chamfer.

6. A sign assembly as claimed in claim 1, wherein said display sign comprises a corner notch.

7. A sign assembly as claimed in claim 1, wherein said sign framing member comprises a main framing member attached to one of a glazed door and window.

8. A sign assembly as claimed in claim 1, wherein said filmic substrate is transparent.

9. A sign assembly as claimed in claim 1, wherein said display sign is adhered to said base material such that in a standard AFERA test procedure, at 23° C., at an angle of 90° to the base material, at a peeling speed of 300 min/minute, the average peeling force is less than 400 gm.

10. A sign assembly as claimed in claim 1, wherein the sign framing member is immovably attached to the base material.

11. The assembly of claim 1, wherein the entire display sign is removable from base material and the sign assembly frame while the sign framing member remains in the fixed position in relation to the base material.

12. The assembly of claim 1, wherein the entire display sign is a single structure.

13. The assembly of claim 1, wherein the projected area of the display sign comprises an area projected perpendicularly away form the display sign and base material.

14. The assembly of claim 1, wherein the entire display sign is removably adhered to the base material.

15. The assembly of claim 1, wherein:

the display sign comprises a first side that faces away from the base material, a perimeter of the first side defines an area that is projected to define the projected area of the display sign, the projected area projects perpendicularly away from the first side, and the first side does not contact any portion of the sign framing member that extends into the projected area.

16. The assembly of claim 1, wherein:

the projected area projects perpendicularly away from the display sign, and the display sign does not contact any portion of the sign framing member that extends into the projected area.

17. The assembly of claim 1, wherein the inside edge of said sign framing member forms a continuous, closed-loop perimeter that defines the opening, and wherein the inside edge is defined at least in part by each of the top, bottom, left, and right side portions, respectively.

18. The assembly of claim 1, wherein:

the opening includes a rectangle shape, and four respective sides of the rectangle shape comprise the top side, bottom side, left side, and right side portions, respectively.

19. The assembly of claim 1, wherein all of said inside edge of said sign framing member is spaced from said base material and said filmic substrate.

20. A method of applying a display sign to a base material through a sign assembly frame, the sign assembly frame comprising a sign framing member, the method comprising:

inserting the display sign through an opening of a sign assembly frame that is in a fixed position in relation to the base material such that an inside edge of an inwardly projecting portion of said sign framing member is located within a projected area of said display sign; and adhering the display sign to the base material, wherein the inside edge forms a continuous, closed-loop perimeter and defines the opening.

21. The method of claim 20, wherein the display sign comprises a filmic substrate imaged with a design.

22. The method of claim 20, wherein said inserting comprises:

positioning a perimeter of the display sign on a side of the sign framing member remote from said base material, and tucking the perimeter of the display sign between the projecting portion of the sign assembly frame and the base material while the sign assembly frame is in a fixed position in relation to the base material.

23. The method of claim 20, wherein, after said inserting and adhering, said inside edge is spaced from said base material and said display sign.

24. The method of claim 20, wherein the inside edge is disposed entirely within the projected area of the display sign.

25. The method of claim 20, wherein the projected area comprises an area projected perpendicularly away from the base material.

26. The method of claim 20, wherein the projected area comprises an area projected perpendicularly to a plane defined by the opening.

27. The method of claim 20, wherein an area defined by the opening is smaller than an area of the display sign.

28. The method of claim 20, wherein the sign assembly frame and base material are integrally formed with each other.

29. The method of claim 20, wherein said display sign comprises a corner notch.

30. The method of claim 20, wherein said inserting comprises inserting the entire display sign through the opening of the sign assembly frame that is in the fixed position in relation to the base material.

31. The method of claim 20, wherein the entire display sign is a single structure.

32. The method of claim 20, wherein said display sign comprises a corner chamfer.

33. The method of claim 20, wherein:

immediately prior to said inserting, the entire display sign is disposed on a side of the opening remote from the base material, and said inserting comprises inserting the entire display sign through the opening such that the entire display sign is disposed on a side of the opening proximate the base material.

34. A method of applying a display sign to a base material through a sign assembly frame, the sign assembly frame comprising a sign framing member, the method comprising:

inserting the display sign through an opening of a sign assembly frame that is in a fixed position in relation to the base material such that an inside edge of an inwardly projecting portion of said sign framing member is located within a projected area of said display sign; and adhering the display sign to the base material, wherein, after said inserting and adhering, an entire perimeter of said display sign is disposed between the sign assembly frame and the base material.

* * * * *